United States Patent [19]

Salomon

[11] 4,196,920

[45] Apr. 8, 1980

[54] SAFETY SKI BINDING

[75] Inventor: Georges P. J. Salomon, Annecy, France

[73] Assignee: Etablissements Francois Salomon et fils, Annecy, France

[21] Appl. No.: 830,247

[22] Filed: Sep. 2, 1977

[30] Foreign Application Priority Data

Sep. 3, 1976 [FR] France ..... 76 26686

[51] Int. Cl.[2] ..... A63C 9/08

[52] U.S. Cl. ..... 280/613

[58] Field of Search ..... 280/613, 618, 617, 636, 280/634, 633, 611, 607, 623; 36/117

[56] References Cited

U.S. PATENT DOCUMENTS

| | | | |
|---|---|---|---|
| 3,410,568 | 11/1968 | Wiley | 280/618 |
| 3,869,136 | 3/1975 | Jackson | 36/117 X |
| 3,918,732 | 11/1975 | Wulf | 280/618 |
| 3,931,980 | 1/1976 | Marker | 280/613 |
| 3,945,656 | 3/1976 | Rohlin | 280/613 |
| 3,957,280 | 5/1976 | Turnheim et al. | 280/613 |
| 4,021,056 | 3/1977 | Oakes | 280/613 |

FOREIGN PATENT DOCUMENTS

| | | | |
|---|---|---|---|
| 1428907 | 5/1969 | Fed. Rep. of Germany | 280/618 |
| 2418867 | 10/1975 | Fed. Rep. of Germany | 280/615 |
| 574838 | 4/1976 | Switzerland | 280/613 |

*Primary Examiner*—Joseph F. Peters, Jr.
*Assistant Examiner*—Milton L. Smith
*Attorney, Agent, or Firm*—Pollock, Vande Sande & Priddy

[57] ABSTRACT

A safety binding for a ski allows the ski to be fitted by rotating the boot thereon in a plane substantially parallel therewith; it comprises means of retention maintaining the boot upon the ski in a locked position along the longitudinal axis thereof, and a system of ramps located in the immediate vicinity of a first of two locking elements cooperating with each other and forming part of the retention means. The second locking element is designed to cooperate with the ramp system during the ski fitting operation, in order to be guided towards the first locking element, the configuration of the ramp system being such that it imparts to the second locking element at least one movement in a direction parallel with the plane of contact between the ski and the boot.

18 Claims, 32 Drawing Figures

1
3
3a
24a
11a
9
5a
2
15
10
12a
24b
e
6
11
7
5
13
8
12

5b
14
5c
Y
X
α
4
F3
X'
F
Y'
9
7
13
10
8

1
3
3a
15
9
5a
2
10
e
A
6
A'
7
20
16
17
8

18
19

20
17

1
3a
3
5a
21
2
22
9
10
e
h
H
6
7
25
23
26
8

28
27
8
10
7
9
25
26

1
3a
3
5a
21
2
30
22
9
10
6
e
7
25
29
26
8

31
28
27

11
X
X
25
30
11
26

1
3a
3
32
39
33
13
13
6
40
43
44

32
36
35
33

42
37
34
44
41
38

1
3
4
A
9
5a
2
R
10
e
6
7
A'
200
160
8

180
170
190
200
170

1
4
3
2
5a
210
220
10
e
2
230

220
230
28
X
X'
210
28

SAFETY SKI BINDING

The present invention relates to safety bindings designed to hold a boot to a ski while allowing the boot to be freed in the event of a safety release.

The invention relates more particularly to so-called "pivoting" safety bindings, in which the ski and the boot (or a plate attached temporarily underneath the boot) cooperate by means of a pivot located under the skier's foot.

This type of binding is generally used in conjunction with a plate attached temporarily under the sole of the boot, the safety release thus occurring between the plate and the ski. During skiing, the plate is locked to the ski by retention means adapted to be released against the action of resilient means.

Certain manufacturers have suggested bindings of this type in which the ski fitting is carried out by a rotational movement of the foot: the skier places his boot transversely in relation to the ski and then rotates his foot about the pivot in order to align it with the longitudinal axis of the ski, in which position the boot is locked to the ski.

French Pat. No. 2,264,573 describes a device of this kind in which the ski is fitted by rotation.

However, because of the design and respective locations of the various elements used to hold the boot to the ski, with the type of binding disclosed, more particularly, by the above-mentioned patent, the binding can be locked in the normal position of retention only if the skier takes certain precautions. In other words, fitting the ski by means of the known devices requires the skier to pay particular attention and to take very great care, since it must be remembered that:

(1) with this type of known binding in which the retention means are under the sole of the skier's foot, the skier has no reference point to assist him in fitting the ski, and he must therefore carry out this operation "blind"; and (2) furthermore, an uneven thickness of snow or mud may accummulate under the sole.

Thus, even under favorable conditions (on flat ground, fitting the ski before a run), fitting the ski is a delicate and difficult operation requiring considerable skill on the part of the skier. It is therefore obvious that fitting the ski on a more or less steep ski-slope, after a safety release following a fall, is a particularly laborious, if not almost impossible, operation, especially if the skier lacks experience. Moreover, if the skier is not careful and lifts his foot before he has re-fitted the ski, the boot will escape and he may well lose the ski or have to begin the operation all over again.

It is an object of the present invention to eliminate these disadvantages and to provide easy and reliable fitting of the ski under all circumstances, and especially to avoid inopportune separation of the boot and ski, even before the boot is locked to the ski. Furthermore, and still with a view to simplifying the fitting of the ski, the present invention makes it possible to fit the ski even when the bottom surface of the sole of the boot is not parallel with the top surface of the ski, also when the bottom surface of the sole is at an angle to the surface of the ski in the longitudinal direction thereof (where one end of the foot is raised in relation to the other), or in the transverse direction thereof (where one lateral edge of the sole is bearing upon the ski). Thanks to the invention, it will, of course, also be possible to fit the ski when the sole is sloping in both the longitudinal and the transverse direction of the ski.

As in French Pat. No. 2,264,573, a binding according to the invention comprises means of holding the boot to the ski along the longitudinal axis thereof, the said means of retention, located under the ski boot, being adapted to provide both vertical and lateral safety releases allowing the boot to be freed in the event of a fall, and comprising at least two locking elements cooperating with each other, one being associated with the boot and the other with the ski, at least one of these locking elements being resiliently retractable, against the action of a resilient element, in order to permit the release.

According to the invention, the binding comprises, in the immediate vicinity of a first locking element, a system of guide ramps with which the second locking element is designed to cooperate, when the ski is being fitted, for the purpose of being guided towards the first locking element, the configuration of the ramp system being such that it imposes upon the second locking element at least a movement in a direction parallel with the plane of contact between the ski and the boot.

The fact that, according to the invention, the guide ramp, or ramps, are arranged under the boot allows the dimensions of the ramp, or ramps, to be compatible with those of the boot. In other words, these dimensions, especially the height, are relatively small. This makes it possible to take up considerable discrepancies in parallelism between the sole of the boot and the ski, because of the closeness of these ramps to the center of rotation of the boot, when the latter moves while the ski is being fitted. If the ramps were located in areas very remote from the center of rotation of the boot, taking up the same discrepancies in parallelism would require ramps of large dimensions, and this would result in increases in cost, weight and size incompatible with this type of binding.

The ramp system may be of any configuration as long as it will assure, at the beginning of the operation of fitting the ski, the take-over, especially in the vertical direction, of the second locking element, and will bring the second locking element into contact with the first.

According to one aspect of the invention, therefore, the configuration of the ramp system may be such that it will impose upon the second locking element a trajectory in a plane parallel with the plane of contact between the ski and the boot.

According to another aspect of the invention, however, the profile of the ramp system will assure that the second locking element will move in directions parallel with, and perpendicular to, the plane of contact between the ski and boot. This is due, more particularly, to the fact that the ramp has a profile sloping towards the first locking element.

In such a case, the configuration of the guide ramp, or ramps, is substantially helical so that the boot carries out a combination of rotating and descending movements when the ski is being fitted.

It should be noted that a binding arranged according to the invention assures vertical take-over of the ski as soon as the ramp system comes into contact with the second locking element; in other words, if, for any reason, the skier lifts his foot before the ski is in the fitted position, the ski will also be lifted because contact is maintained between the ramp system and the second locking element, and the relative positions of the ski and the boot will not be affected. This will eliminate the loss of the ski and the need to start the fitting operation all over again, as in the case of known bindings.

This arrangement also reduces friction on the ski while it is being fitted, since the boot need not be in contact with the ski at that time, and since locking will be achieved only at the end of the travel.

According to one embodiment in which the locking elements consist:

(a) on the one hand, of a housing arranged in a block integral with the ski, and (b) on the other hand, of a spring-loaded moving piston accommodated in a component at least temporarily integral with the boot; at least one guide ramp is arranged in the block integral with the ski.

The present invention permits several variants of such a binding, depending upon the functions it is required to fulfill. For instance, if the ski is to be fitted with the boot always in the same position relative to the ski, only one guide ramp might be provided in the block. On the other hand, if it is to be possible to fit the ski from any position, a guide ramp will preferably be arranged on each side of the housing in the block integral with the ski. Similarly, if the boot is held to the ski by two pairs of locking elements arranged along the longitudinal axis of the ski, one pair holding the front and the other pair holding the rear of the boot to the ski, two pairs of guide ramps will be provided, each pair of guide ramps being associated with a pair of locking elements.

According to another aspect of the invention, and still for the purpose of facilitating the fitting of the ski, the part of the surface of the boot which rests upon the ski and is located under the toe of foot may be chamfered laterally, starting from the longitudinal axis of the boot, so that when the boot is resting upon the ski, the chamfered part is at an angle to the ski. It is desirable to arrange for this part of the surface of the boot, which rests upon the ski, to be chamfered on each side of an edge running along the longitudinal axis of the boot, the edge serving to support the boot when it is in its normal position of retention.

According to a variant designed to simplify still further the fitting of the ski, a depression in the sole of the boot (or in the plate temporarily attached thereto), designed to cooperate with the block secured to the ski, is provided with a pin running at right angles to the support surface of the boot (or of the plate) and towards it, the pin cooperating with a cavity arranged in the top surface of the block integral with the ski; this cavity is preferably in the form of a slot running in the direction of the longitudinal axis of the ski, the width of the slot being slightly greater than the diameter of the pin.

Several embodiments of the invention will now be described with reference to the drawings attached hereto, wherein.

For the sake of simplicity, similar elements in the following description bear the same reference numerals.

Figure 14:
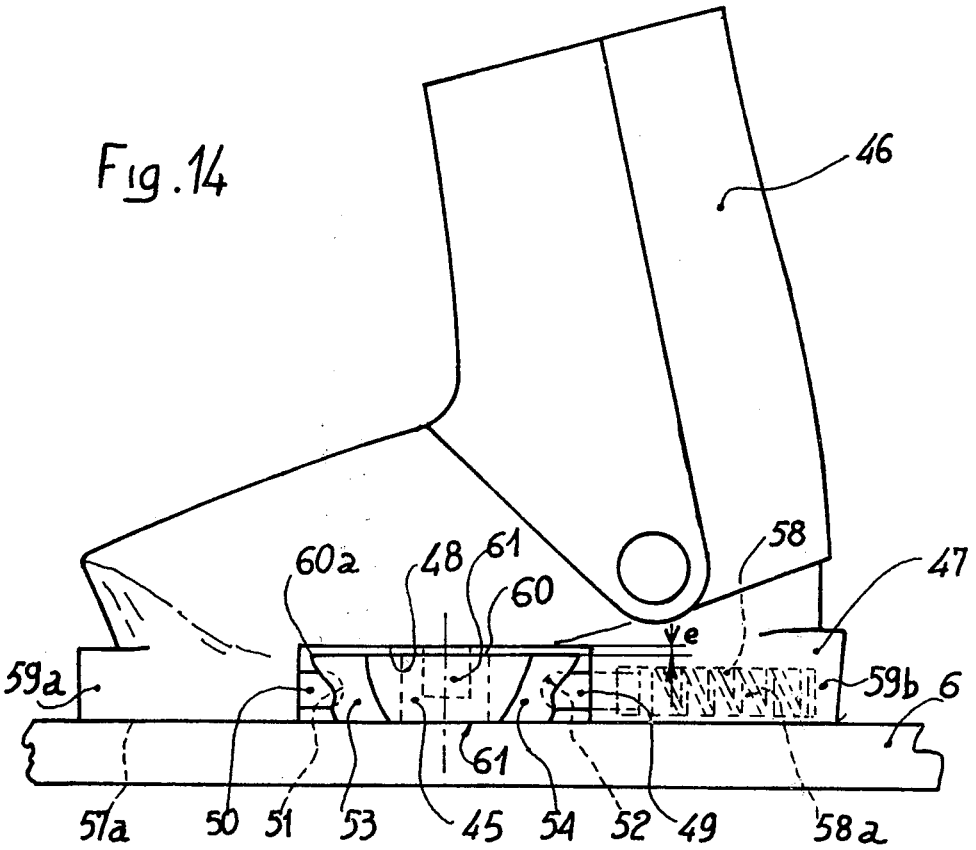
FIGS. 14 and 15 are a side elevation, with the ski fitted, and a plan view, respectively, of a variant in which the boot has no intermediate plate, and in which the block integral with the ski also provides vertical retention prior to locking.
Figure 15:
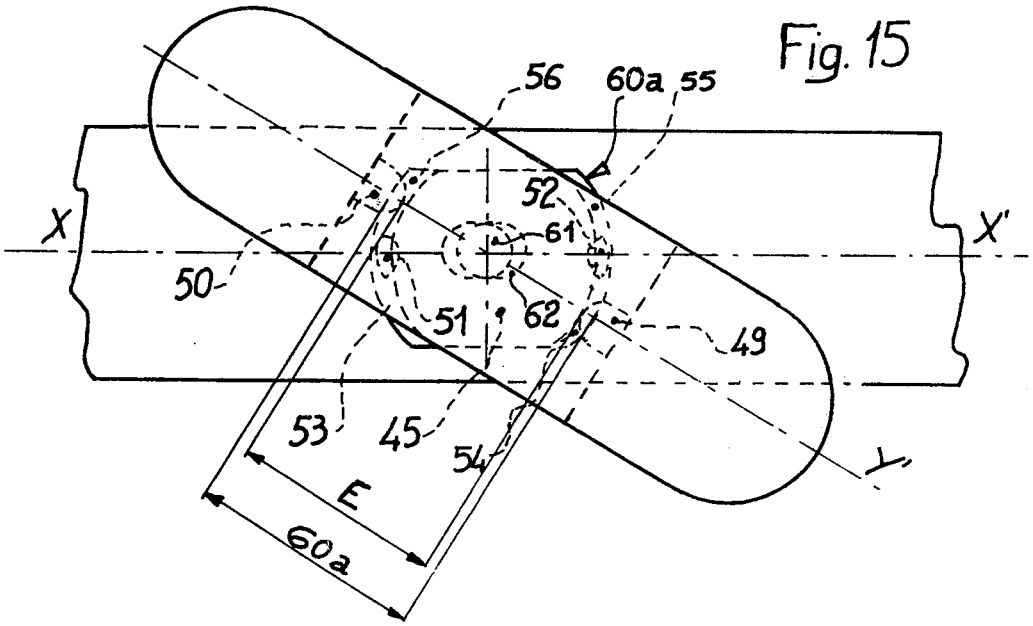

Generally speaking, the examples illustrated comprise an intermediate plate attached temporarily under a boot, the safety release occurring between the plate and the ski. The boot is held to the plate by conventional means, in such a manner that the two components function as a single block. However, there would, of course, be no departure from the scope of the invention if there were no intermediate plate, or if the safety release were to occur directly between the boot and the ski. In this case, of course, the actual sole of the boot would be shaped like the plate described and would be equipped with the same elements (see, more particularly, FIGS. 14 and 15 illustrating this embodiment).

Figure 1:
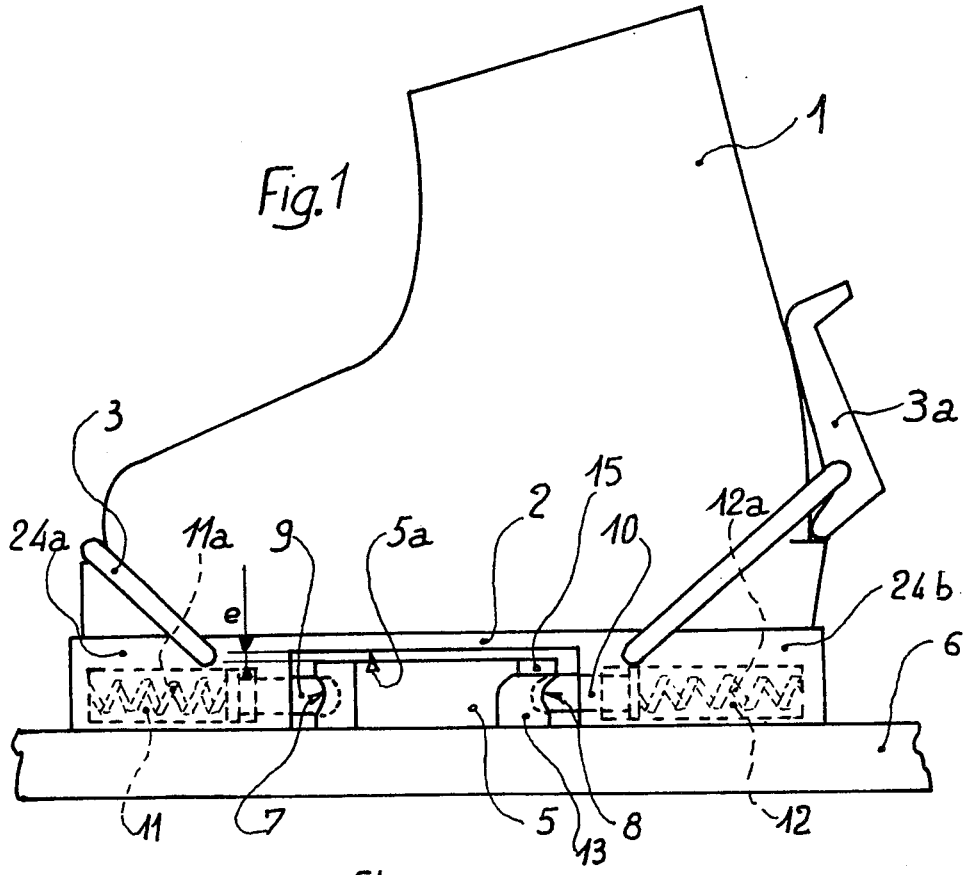
FIG. 1 is a side elevation of a first embodiment of a binding according to the invention, with the ski fitted.
Figure 2:
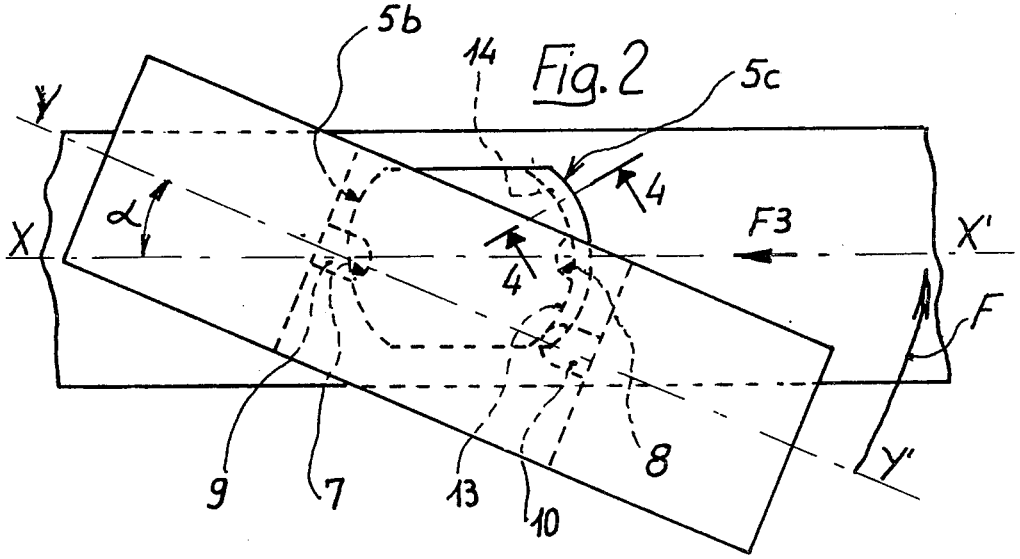
FIG. 2 is a plan view of the binding illustrated in FIG. 1, in the position in which the ski is being fitted, the boot being removed.
Figure 3:
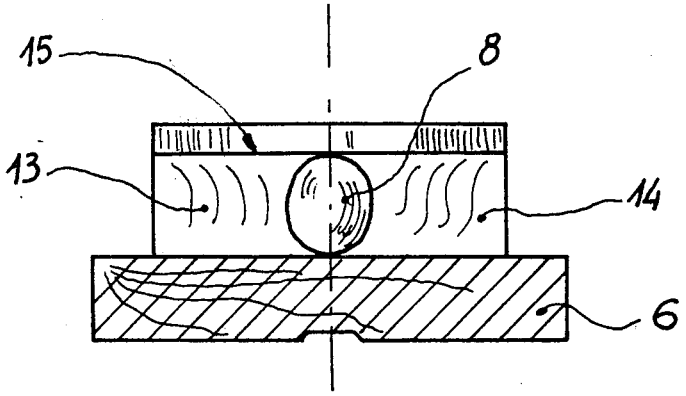
FIG. 3 is a view in the direction of arrow F3 in FIG. 2, showing, to an enlarged scale, the block mounted upon the ski.

In the embodiment illustrated in FIGS. 1 to 3, a boot 1 is shown, underneath which a plate 2 is attached, in such a manner as to form a single block, by a front binding 3 and a rear binding 3*a* of known type which will not be described in detail. It will suffice to indicate that these bindings are detachable to allow separation of the boot and of the plate when the assembly is not being used for skiing. In this embodiment, safety releases occur between the plate and ski, so that, in the event of a fall, the boot and the plate can be released but remain attached to each other.

Secured to the top surface of ski 6, along longitudinal axis XX' thereof, is a block 5. Designed to cooperate with this block and having a connecting relationship therewith is a depression 5*a* arranged in the bottom surface of plate 2, in an area corresponding to the sole of the skier's foot. This depression 5*a*, which in the example illustrated, is a cut-out opening laterally out of the sides of the plate, is higher and longer than block 5. Moreover, block 5, front wall 5*b* and rear wall 5*c* of which are arcs of a circle, also comprises two locking housings 7,8 in alignment with longitudinal axis XX'. These housings are designed to cooperate with moving pistons 9,10 mounted in channels 11,12 arranged in parts 24*a*,24*b* of plate 2, the channels being in alignment with longitudinal axis YY' of the plate. Pistons 10,9 are urged to project into the interior of depression 5*a* by means of springs 11*a*,12*a* housed in channels 11,12. In the position shown in FIG. 1, which is the position in which the boot is normally held to the ski, the rounded ends of pistons 9,10 are engaged in housings 7,8 in block 5, and thus elements 7, 8, 9 and 10 jointly form retention means which lock the plate in relation to the ski. Lateral and vertical safety releases are effected by retracting one or the other, or both, of pistons 9,10 against the action of their springs.

Figure 4:
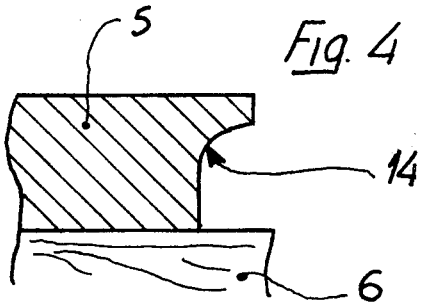
FIG. 4 is a section through the block along line 4—4 in FIG. 2, to an enlarged scale.

As may be seen in FIGS. 1 and 2, two guide ramps 13,14 are arranged in block 5 on each side of rear housing 8. These ramps are preferably symmetrical in relation to the longitudinal axis of the ski and, while the ski is being fitted, they allow piston 10 to be moved automatically into its corresponding housing 8. To this end, ramps 13,14 which, as may be seen more particularly in FIG. 4, are concave, are of a configuration such that the edge formed by the intersection of one of the ramps with outer wall 5*c* of the block lies within a plane parallel with the top surface of the ski. This produces a shoulder 15 overhanging ramps 13,14.

As may be seen in FIG. 2, all that is required to refit the ski after a release is for the skier to engage front piston 9 in housing 7 by placing his boot at an angle $\alpha$ in relation to the ski.

The skier need then only bring the rear part of the boot to the longitudinal axis of the ski by rotating it in the direction of arrow F. Piston 10 will come into contact with ramp 13 and, as the rotation continues, will automatically enter housing 8.

Figure 5:
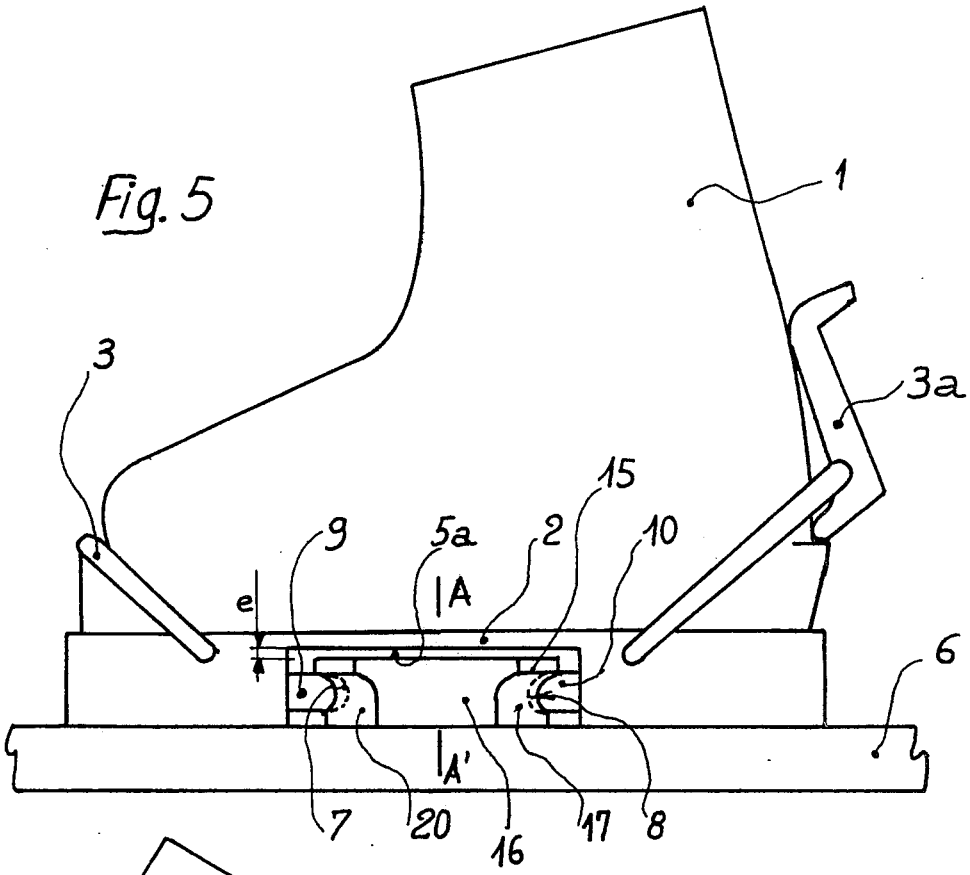
FIG. 5 is a side elevation of a second embodiment of a binding according to the invention, with the ski fitted.
Figure 6:
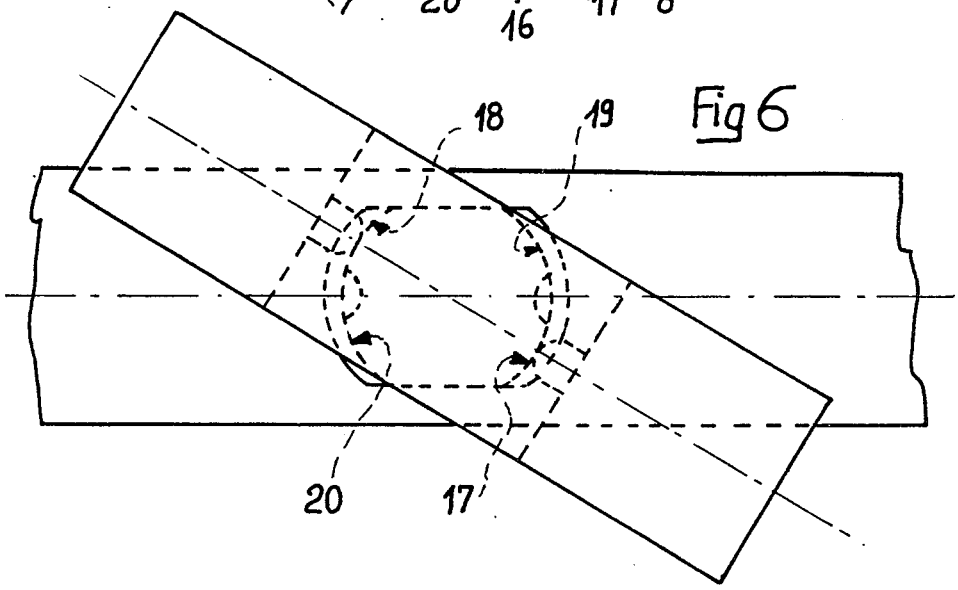
FIG. 6 is a plan view of the binding illustrated in FIG. 5, in the position in which the ski is being fitted, the boot being removed.

FIGS. 5 and 6 illustrate a variant in which central block 16, secured to the ski, is symmetrical in relation to a vertical plane AA'. In other words, block 16 has two pairs of ramps 17-19 and 18-20 located on each side of locking housings 7,8 for pistons 9,10. As in the preceding example, ramps 17,18,19,20 are of a configuration such that the edge of shoulder 15 is parallel with the plane of the ski.

With this variant, the skier is no longer required, as he is the preceding case, to place the toe of his boot in a special position which will permit piston 9 to enter its housing 7. All he needs to do is to engage block 16 in depression 5*a* in the plate. The sole may be in any position. By rotating his foot, the skier brings pistons 9,10 into contact with diametrically opposed ramps 17,18 or 19,20. As the rotation continues, the pistons will automatically engage in their respective housings 7,8. It will be observed that the two pairs of ramps make it possible to fit the ski by presenting the toe of the boot either towards the outside or towards the inside of the ski. In the embodiment illustrated in FIGS. 5 and 6, ramps 17,19 will preferably be identical with ramps 13,14 in the previous embodiment, while ramps 18,20 will be symmetrical with ramps 17,19.

Figure 7:
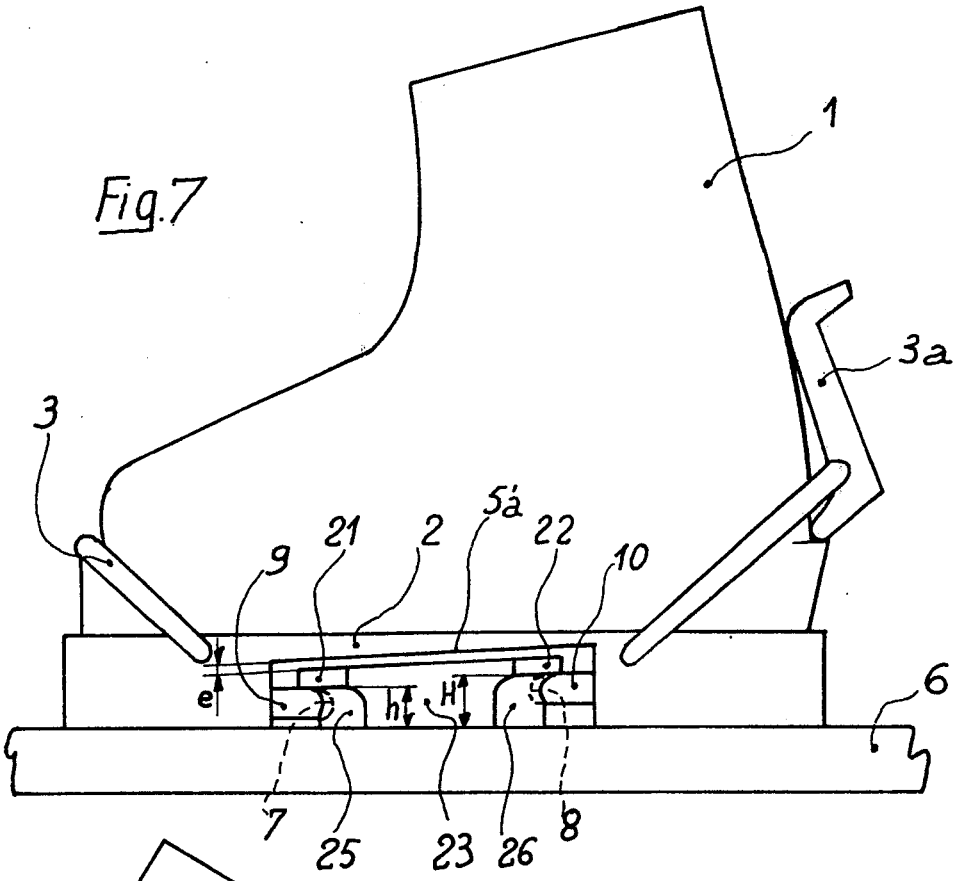
FIG. 7 is a side elevation of a third embodiment, with the ski fitted.
Figure 8:
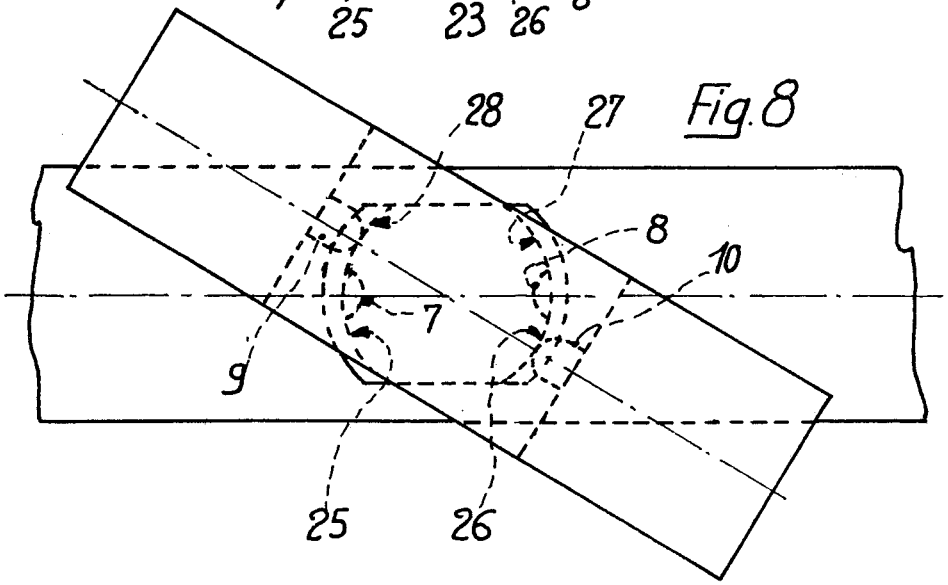
FIG. 8 is a plan view of the binding illustrated in FIG. 7, in the position in which the ski is being fitted, the boot being removed.

FIGS. 7 and 8 illustrate a third embodiment of the invention. This binding is of the same type as that in FIGS. 5 and 6 as regards block 23, the block having two pairs of ramps which make it possible to fit the ski without presenting the toe of the boot in a special position, as was required in the design according to FIGS. 1 to 3.

This embodiment differs from that in FIGS. 5 and 6 in that shoulders 21,22 which restrict the height of ramps 25,28 and 26,27 respectively, are located in different planes from each other, but are still parallel with the top surface of the ski. As in the case of the preceding design, the skier is no longer required initially to present the toe of the boot in a special position which will allow piston 9 to engage in its housing 7. On the contrary, with the sole in any desired position, he may bring pistons 9,10 into contact with diametrically opposed ramps 25,27 or 26,28, whereupon he rotates his boot which automatically causes the pistons to engage in their respective housings 7,8. The difference between heights h and H (FIG. 7) of shoulders 22,21 facilitates the fitting of the ski by compensating for the natural tendency of skiers to keep their heels always raised to a greater or lesser degree when fitting their skis. This shoulder 21 adjacent the toe of the foot is at a distance h from the ski less than the distance H separating rear shoulder 22 from the surface of the said ski. In this case, the top surface of block 23 may be inclined to match a corresponding slope on the bottom 5'a of the depression.

Figure 9:
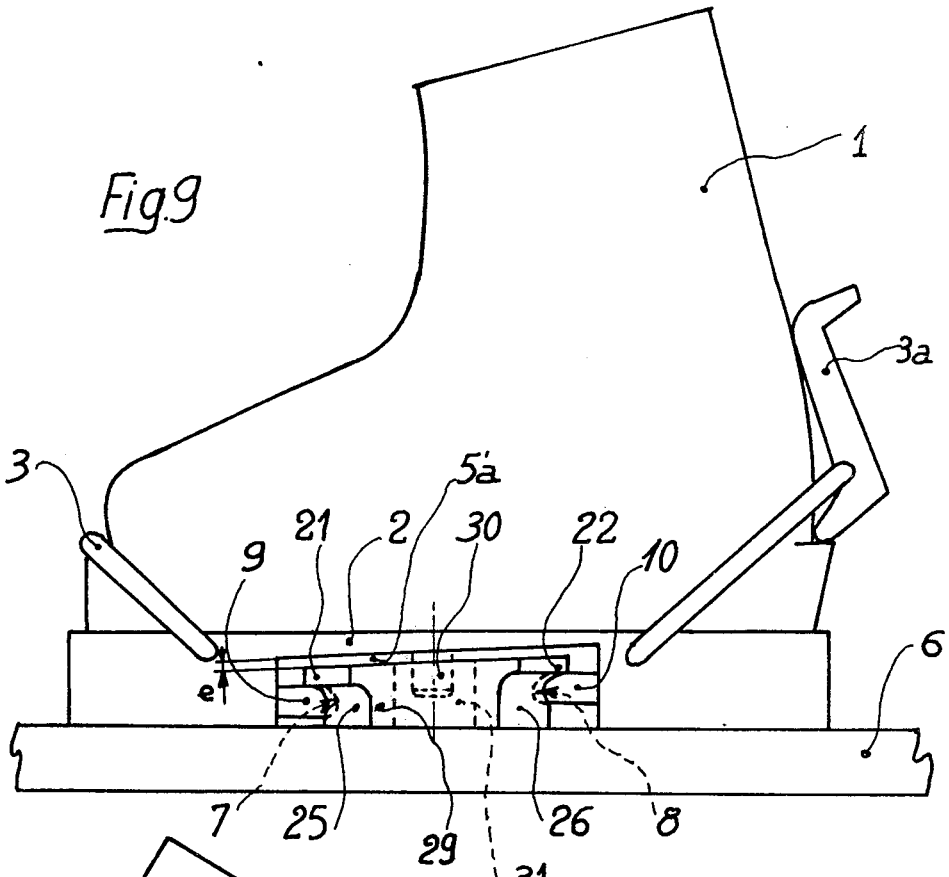
FIG. 9 is a side elevation of a fourth embodiment, with the ski fitted.
Figure 10:
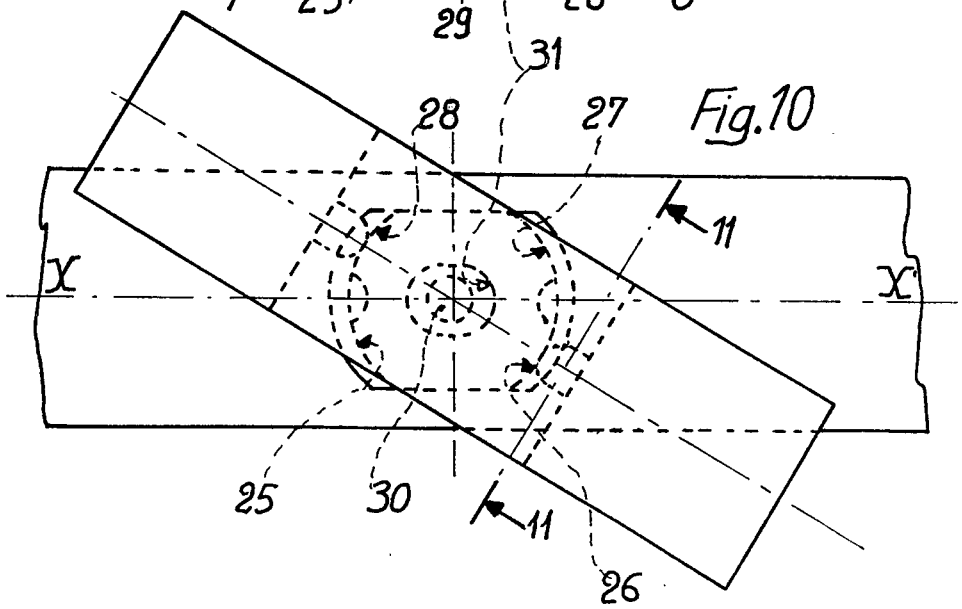
FIG. 10 is a plan view of the binding illustrated in FIG. 9, in the position in which the ski is being fitted, the boot being removed.

FIGS. 9 and 10 illustrate a fourth embodiment of the invention. This binding is identical with that illustrated in FIGS. 7 and 8 as regards block 29 which has two pairs of ramps identical with the ramps in FIGS. 7 and 8.

However, the top surface of block 29 has an oblong cavity 21 extending along longitudinal axis XX' of the ski. Furthermore, a cylindrical pin 30 extends vertically from the bottom surface of depression 5'*a* in plate 2, the pin being designed to engage in cavity 31, the width of which is slightly greater than the diameter of the pin. As a result of this, there is a possibility of play between the pin and cavity, both in the direction of the longitudinal axis XX' of the ski and in the direction at right angles thereto. This cooperation between the pin and cavity makes it easier for the skier to center his boot on block 29 as he presents it at an angle to the ski. This arrangement therefore makes it still easier to fit the ski. Moreover, the play between pin 30 and cavity 31 naturally allows the bottom surface of the boot to be presented at an angle to the top surface of the ski. The cavity might, of course, be of a different shape—circular, for example. Furthermore, the existence of a pin 30 makes it possible to impose a definite trajectory on the ski in the event of a safety release.

Figure 11:
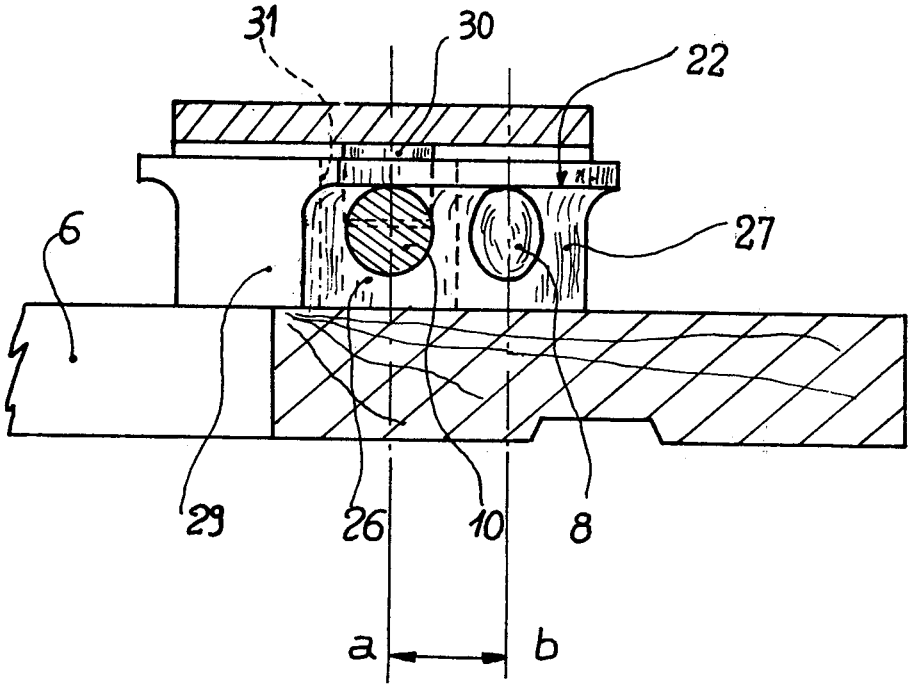
FIG. 11 is a section along line 11—11 in FIG. 10 to an enlarged scale.

FIG. 11 illustrates particularly clearly the significance of guide ramp 26 and its shoulder 22 when the ski is being fitted. It may be seen in this figure that at the beginning of the ski-fitting procedure, piston 20 is tangential to shoulder 22 and thus holds ski 6 vertically while it is being fitted. In other words, as soon as the piston and the shoulder begin to cooperate, the boot and the ski are connected to each other, and this eliminates any wrong moves while the ski is being fitted. During this time, piston 10 therefore carries out a rotational movement imparted by the skier's foot, slides on ramp 26, is guided by shoulder 22, and thus follows path a-b. When the piston reaches housing 8 and enters it, this completes the locking. This procedure also applies to the other piston.

In the four preceding embodiments, and in that illustrated in FIG. 14, it is the bottom surface of the plate (or of the boot if there is no plate) which is in contact with the top surface of the ski. A gap e is therefore provided between the top surface of block 5,16,23,29 or 45 and the bottom surface of depression 5*a*, in order to prevent these two surfaces from bearing one upon the other. It would be possible, however, to provide a different arrangement without departing from the scope of the invention. For instance, the bottom surface of depression 5*a* in the plate might bear upon the top surface of block 5,16,23,29 or 45, but in this case it would, of course, be necessary to prevent the bottom surfaces of the front and rear parts of the plate from bearing against the ski, from which it would have to be spaced. Furthermore, in the proposed embodiments, the guide ramps make it possible to fit the ski from the right or left in relation to the longitudinal axis of the ski. This is not a mandatory arrangement. In fact it would be possible to arrange for the ski to be fitted only from the right or only from the left, or for one ski to be fitted from the right and the other from the left. In this case there would be a corresponding reduction in the number of ramps.

Figure 12:
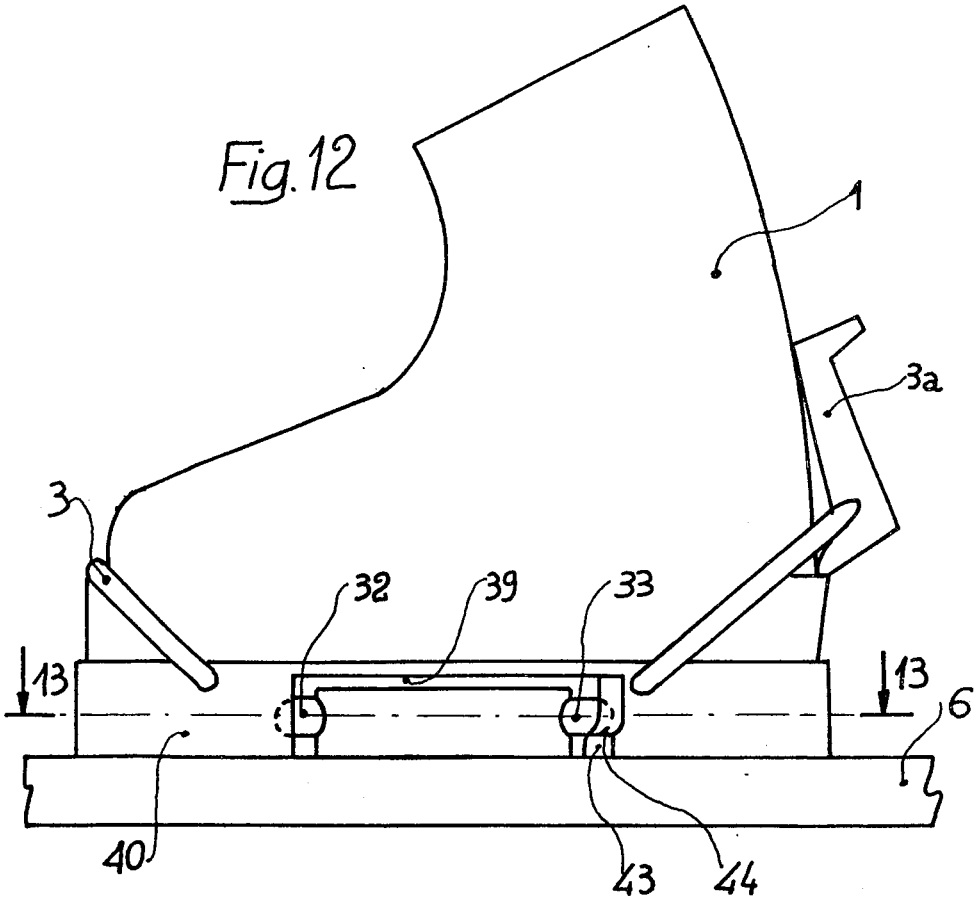
FIGS. 12 and 13 are a side elevation and a section (along line 13—13 in FIG. 12) respectively of a variant in which a guide ramp is provided in a part integral with the boot.
Figure 13:
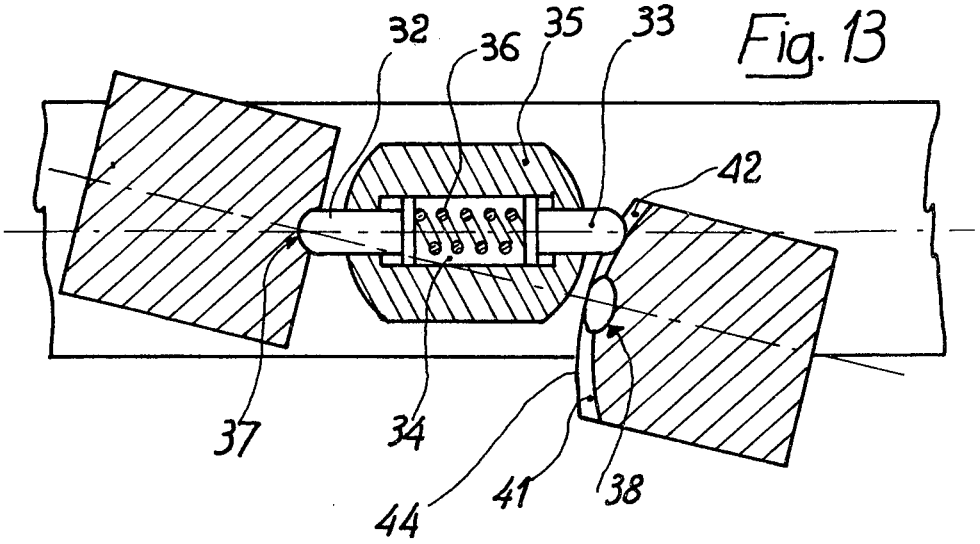

Finally, as shown in FIGS. 12 and 13, and as a variant of all of the preceding embodiments, pistons 32,33 could be mounted in a longitudinal channel in a block 35 secured to the ski, with a common spring causing the pistons to project into the interior. In this case, housings 37,38, designed to cooperate with the pistons, are arranged in the front and rear faces of cut-out 39 in plate 40 which is attached temporarily underneath the boot. In the same way, the guide ramps are arranged in the plate.

In FIGS. 12 and 13, a single pair of ramps 41,42 is provided on each side of rear housing 38. The rear wall of cut-out 39 is convex at 43 in order to allow piston 33 to move, and edge (or shoulder) 44, produced by the intersection of ramp 41-42 and wall 43 is, of course, parallel with the plane of the top surface of the ski.

FIGS. 14 and 15 illustrate another design of ski-fitting ramps which also provide vertical retention during fitting, even before locking in the skiing position.

Furthermore, in this embodiment, there is no plate temporarily secured under the boot as in the preceding example, the actual sole of the boot itself being in contact with the ski. In this case a depression 48, opening out laterally is provided in the lower part of the boot. As in the preceding designs, there are two projecting fingers 49,50 on the longitudinal axis. Projection 50 is stationary, whereas projection 49 is loaded with a spring 58*a* in order to assure the safety release. A pin 61 extends substantially perpendicularly from the center of the depression and cooperates with a slot 62 in a block 45 rigidly secured to the ski. Front finger 50 is designed to cooperate, in the locking position, with housing 51 and rear finger 49 with housing 52 in the block. Guide ramps 53,55 and 56,54 are in the form of walls of substantially truncated-conical shape. It will be understood that the ramps thus shaped assure vertical retention before the locking position is reached, since the design assures that distance E between fingers 49 and 50 is always less than distance D between upper shoulders 60 of the block. Thus, when the ski is being fitted, fingers 49,50 are recessed in relation to edges or shoulders 60*a*.

The ramps in this design are curved in a plane perpendicular to the ski.

It will furthermore be understood that there will be no departure from the scope of the invention if one of the two pistons 9 or 10, 32 or 33 of the retention means were in the form of a stationary, non-retractable projection and the other piston were to be spring-loaded, as is the case in FIGS. 14 and 15. Also, any number n of pistons (n being more than 2) could be provided, as could any other type of locking element, for example pivoting jaws, pivoting fingers, etc.

It would also be possible, of course, to provide, in the same way, a structure identical with the design in FIGS. 9 and 10, with a pivot and a double set of ramps (the ramps in that case being on the boot).

A description will now be given, with reference to FIGS. 16 to 32, of designs allowing the ski to be fitted even if the skier's foot is presented at an angle in relation to the ski.

Figure 16:
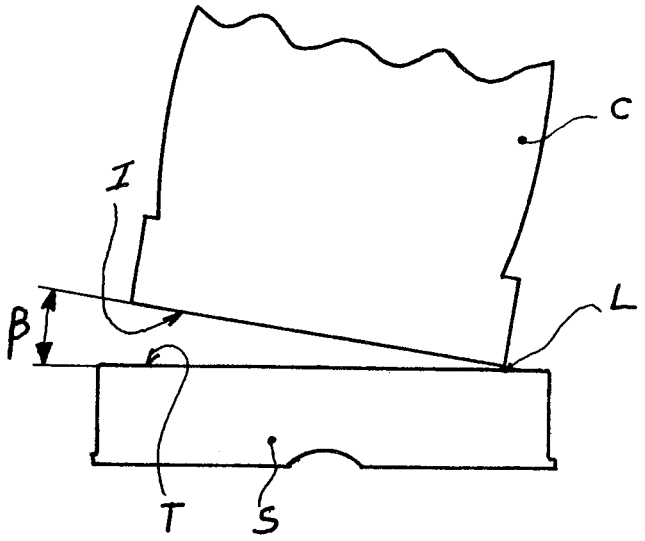
FIGS. 16 and 17 are diagrams showing the various inclined positions which may be assumed by the boot in relation to the ski when the ski is being fitted.
Figure 17:
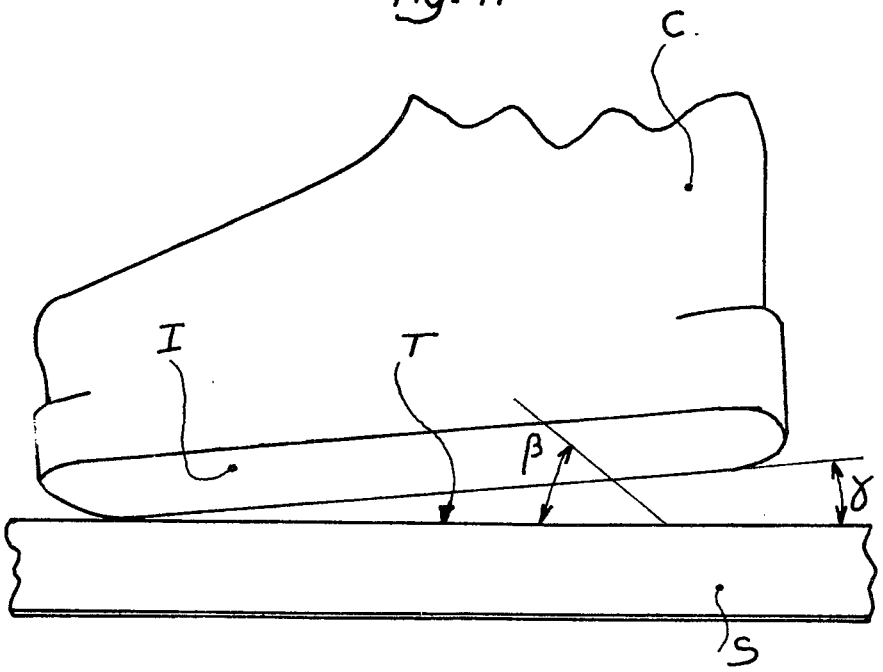

FIGS. 16 and 17 illustrate diagrammatically the positions that may be assumed by bottom surface I of a boot C, or by a plate attached to the boot, in relation to the top surface T of a ski S when a ski is being fitted under difficult circumstances.

FIG. 16 is an end-view of the ski in which it may be seen that bottom surface I of the boot or of the attached plate, instead of being parallel with surface T of the ski, is in contact therewith by lateral edge L, so that surfaces I and T form an angle $\beta$. It will be readily understood that, under these circumstances, the skier could not fit conventional bindings such as those disclosed in French Pat. No. 2,264,573, whereas the device described hereinafter makes it easy to fit the ski with the boot in the position shown in FIG. 16.

FIG. 17, which is a side elevation of a ski S, the top surface of which is marked T, shows that bottom surface I of boot C is sloping, i.e. the toe of the boot is in contact with the ski, whereas the heel is raised, so that the longitudinal axis of the ski forms an angle $\gamma$ with the longitudinal axis of the boot. It should be noted that the boot in FIG. 17 is at an angle to the ski not only in the longitudinal plane of the ski (angle $\beta$), but also in the transverse plane of the ski (angle $\gamma$). Here again, the present invention allows the ski to be fitted without any difficulty from the positions shown in FIG. 17.

A more precise description will now be given of the characteristics of this design, with reference to FIGS. 18 to 32.

Generally speaking, the designs in these figures differ from those in the preceding figures only in that the ski-fitting ramps provide for the locking piston to be guided not only in a plane parallel with the ski, as in the preceding cases, but also in a sloping direction (even perpendicular) in relation to the ski. Only the original parts of these devices will be described.

In the design illustrated in FIGS. 18 to 21, as in that shown in FIGS. 1 to 4, boot 1 is associated with a plate 2 secured to the boot, in such a manner as to form a block therewith, by means of a front binding 3 and a rear binding 4 of known type identical with those in the preceding examples.

Secured to the top surface of ski 6, along longitudinal axis XX' thereof, is a block 105 which differs slightly from block 5 in FIG. 1. Designed to cooperate with this block is a depression 5*a* in the bottom surface of plate 2, in an area corresponding to the sole of the skier's foot. This plate is identical in all respects with plate 2 in FIG. 1, and the same elements bear the same reference numerals.

Block 105, front wall 105*b* and rear wall 105*c* of which are arcs of a circle, also comprises two locking housings 7,8 in alignment with longitudinal axis XX'. These housings are designed to cooperate with moving pistons 9,10 mounted in channels 11,12 in parts 24*a*,24*b* of plate 2, the channels being in alignment with longitudinal axis YY' of the plate.

Figure 18:
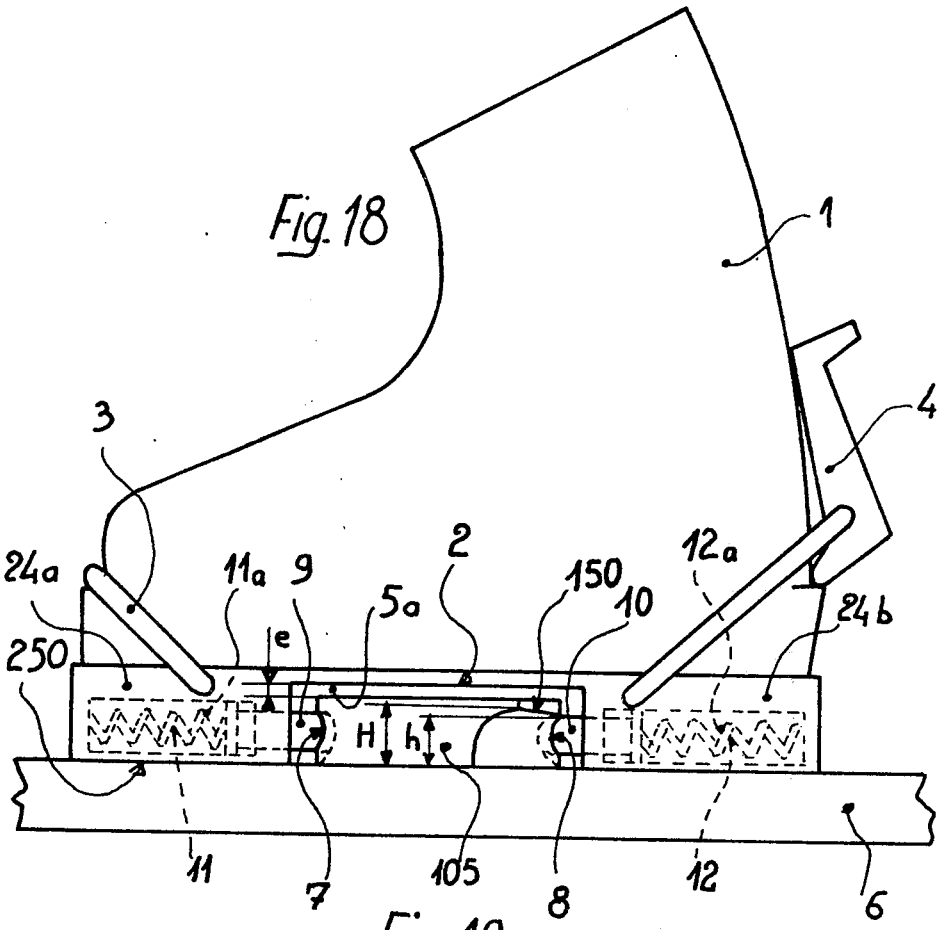
FIG. 18 is a side elevation of an embodiment of a binding according to the invention with sloping ramps, with the ski fitted.
Figure 19:
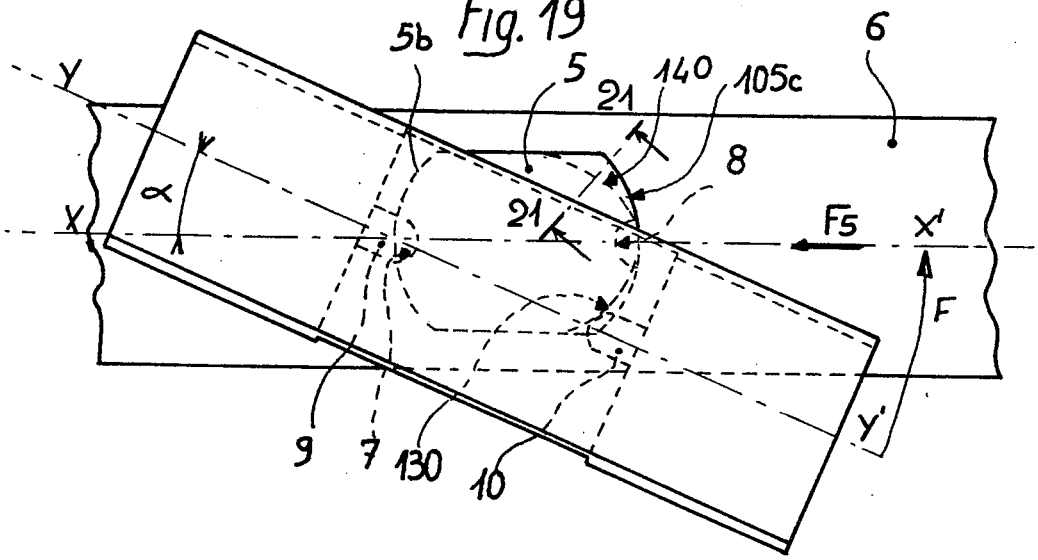
FIG. 19 is a plan view of the binding illustrated in FIG. 18, in the position in which the ski is being fitted, the boot being removed.
Figure 20:
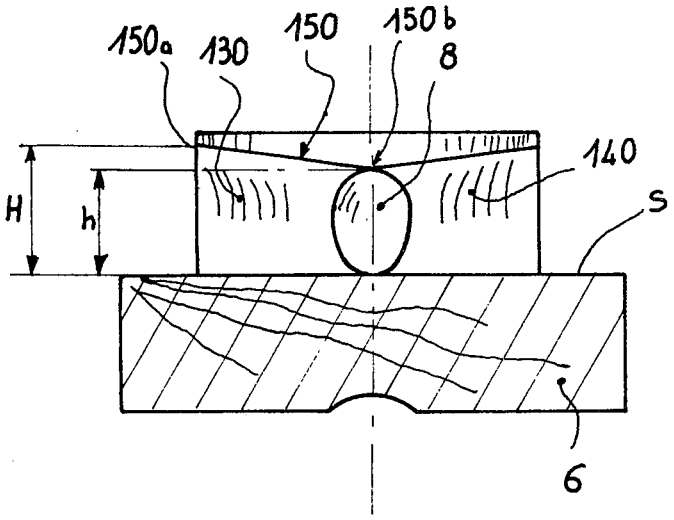
FIG. 20 is a view in the direction of arrow F5 in FIG. 19 showing the block mounted upon the ski, to an enlarged scale.
Figure 21:
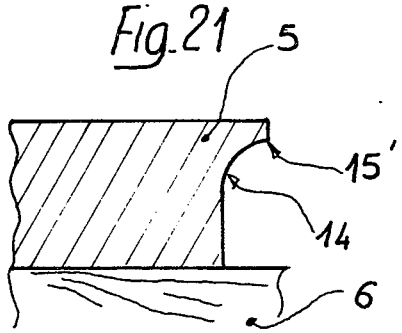
FIG. 21 is a section through the block along line 21—21 in FIG. 19, to an enlarged scale.

As may be seen in FIGS. 18 and 19, two guide ramps 130,140 are arranged in block 5 on each side of rear housing 8. These ramps are preferably symmetrical in relation to the longitudinal axis of the ski and are such that if, at the time of fitting the ski, the boot is in one of the positions shown in FIG. 16 or 17, they allow piston 10 to be moved automatically into its corresponding housing 8. To this end, ramps 130,140, which as may be seen more particularly in FIG. 20, are concave, are of a helicoidal configuration such that edge 150, formed by the intersection of one of the ramps with outer wall 105*c* of the block, slopes towards the top surface of the ski and towards housing 8. In other words, end 150*a* of the ramp farthest away from housing 8 is at a distance H from top surface S of the ski, whereas end 150*b* of edge 150, which terminates at housing 8, is at a distance h from surface S of ski 6 which is less than distance H. It will be noted that although, in the example illustrated, edge 150 is in the form of a helix, any other curve could be used, as long as it would allow the same result to be obtained.

As may be seen in FIG. 19, all that is needed, after a release, is for the skier to engage front piston 9 in housing 7 by placing the boot at an angle $\alpha$ in relation to the ski.

Even if the bottom surface of the plate is not parallel with the ski, the skier need only move the rear part of the boot to the longitudinal axis of the ski by rotating it in the direction of arrow F. Piston 10 will then come into contact with the ramp and further rotation will cause the back of the boot to descend until the piston automatically enters housing 8.

In order to allow the bottom of the plate to be placed at a still larger angle to the ski, front part 24*a* of the plate may be chamfered (backed off).

Figure 22:
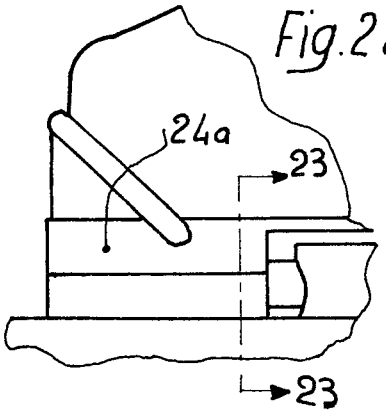
FIGS. 22 and 23 illustrate a partial lateral view and a cross section, respectively, of a variant of the front of an intermediate plate upon which the boot is mounted.
Figure 23:
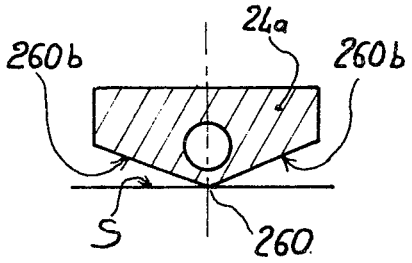

FIGS. 22 and 23 illustrate a variant in which the front part of the plate is bevelled. From an edge 260 extending along longitudinal axis YY' of the plate, the bottom surface thereof has two sloping planes 260*a*,260*b* forming any desired angle with the top surface S of the ski. It will be understood that this arrangement makes it possible for the skier to present his boot at a larger angle to the ski than that shown in FIG. 18 in which the bottom surface of front part 24*a* of the plate is flat. Edge 260 serves as a support upon the ski, to assure that the foot is correctly positioned when the ski is fitted, and this edge is certainly indispensable where the front and rear parts of the plate rest upon the ski. It will be noted that an additional advantage of this arrangement is that it reduces friction during the fitting of the ski, since the only contact between the ski and the front part of the plate is edge 260.

Figure 24:
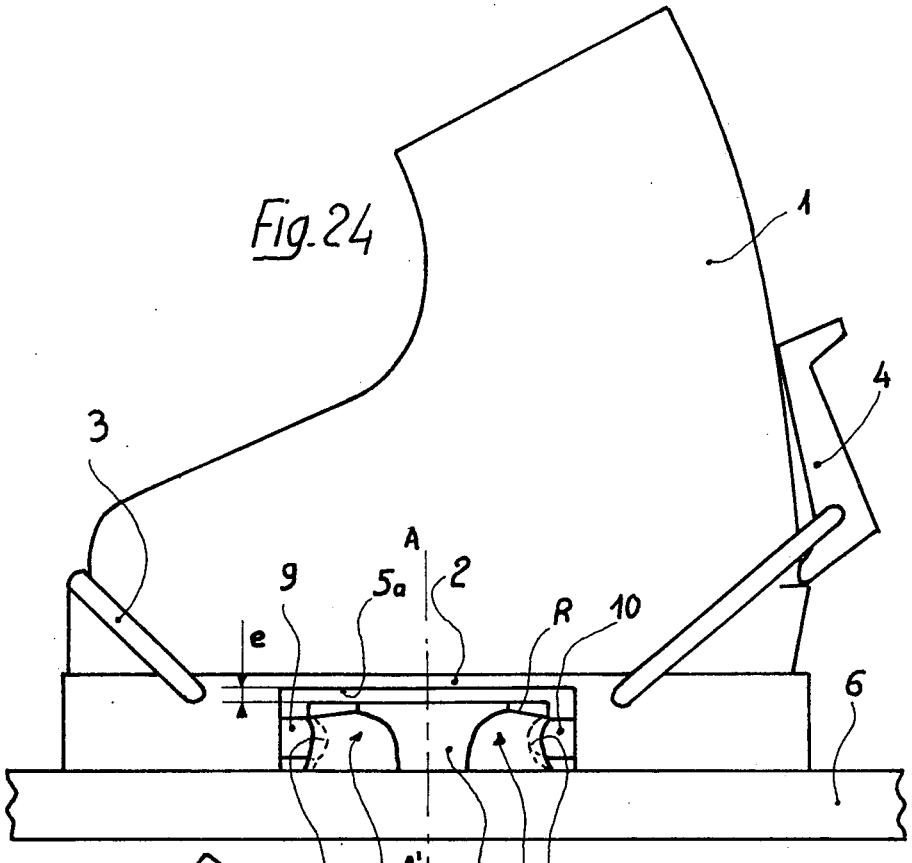
FIG. 24 is a side elevation of another embodiment of a binding according to the invention, comprising sloping ramps, with the ski fitted.
Figure 25:
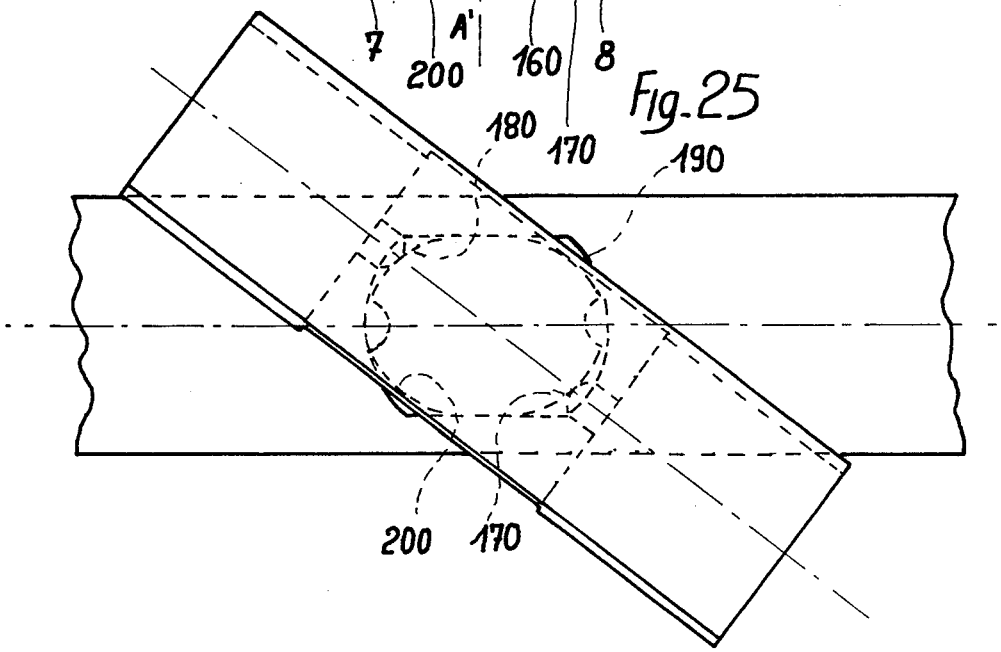
FIG. 25 is a plan view of the binding illustrated in FIG. 24, in the position in which the ski is being fitted, the boot being removed.

FIGS. 24 and 25 illustrate a variant related to that shown in FIGS. 5 and 6, in which central block 160, secured to the ski, is symmetrical in relation to a vertical plane AA'. In other words, block 160 has two pairs of ramps, 170-190 and 180-200 respectively, located on each side of locking housings 7,8 associated with pistons 9,10. As in the preceding example, these ramps are of a helicoidal configuration, with top edge R thereof sloping towards housing 7 or 8.

The advantages of this arrangement are the same as those mentioned above in connection with FIGS. 5 and 6.

Figure 26:
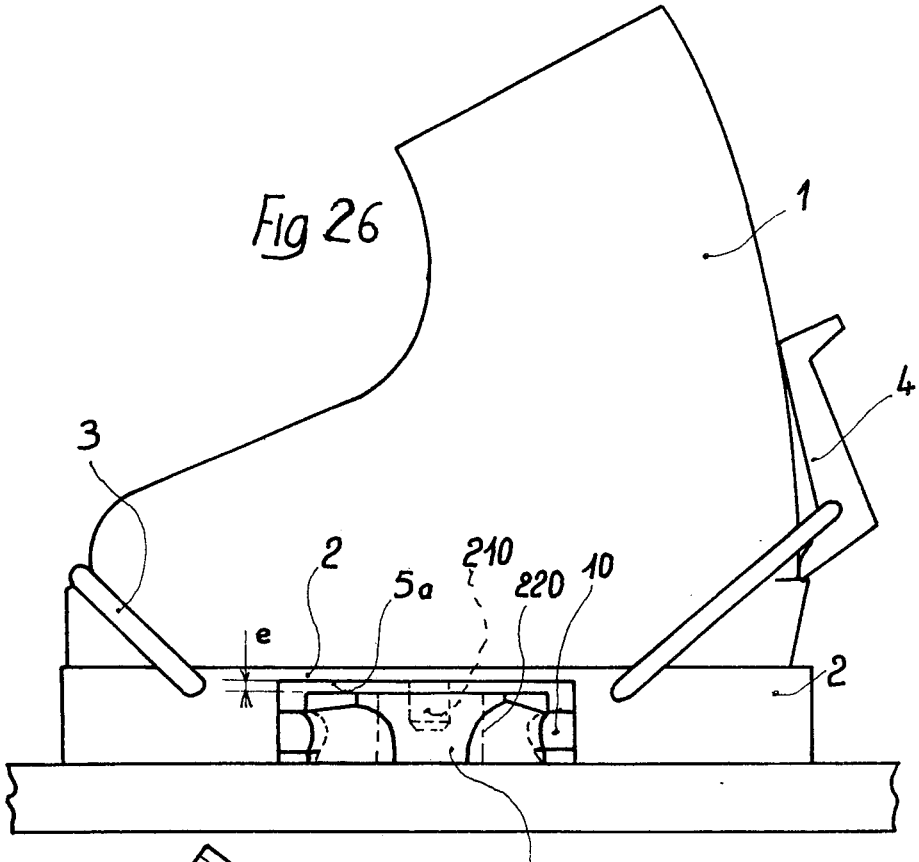
FIG. 26 is a side elevation of another embodiment, with the ski fitted.
Figure 27:
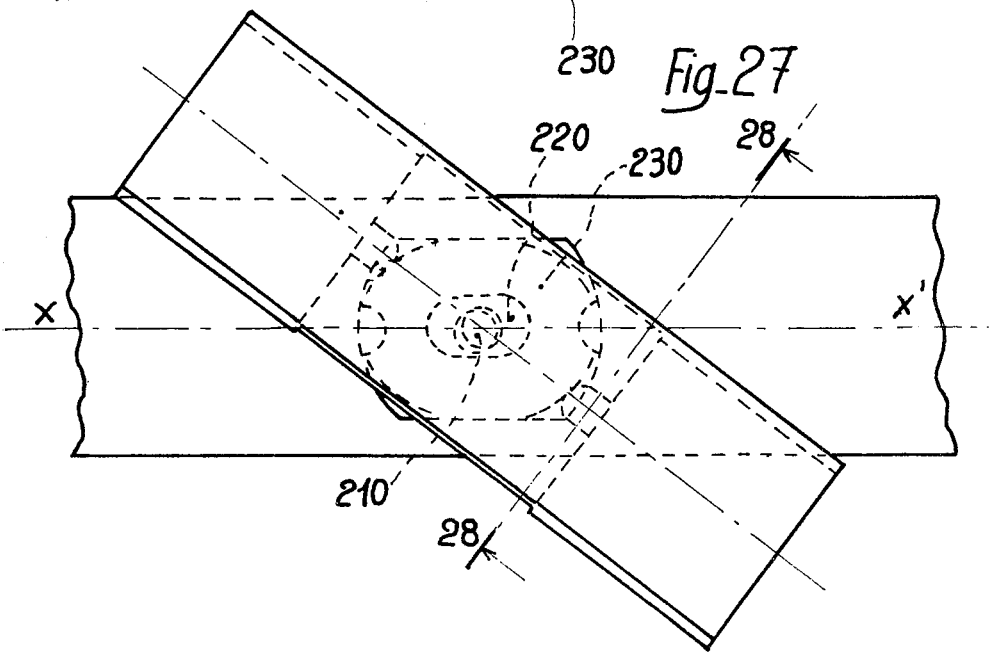
FIG. 27 is a plan view of the binding illustrated in FIG. 26, in the position in which the ski is being fitted, the boot being removed.

FIGS. 26 and 27 illustrate another embodiment of the invention. This binding is identical with that shown in FIGS. 24 and 25 as regards block 230 which has two pairs of ramps identical with those in FIGS. 24 and 25. However, the top surface of block 230 comprises an oblong cavity extending in the direction of longitudinal axis XX' of the ski. Moreover, a cylindrical pin 210 projects vertically from the bottom surface of depression 5*a* in plate 2, the pin being designed to engage in cavity 220, the width of which is slightly larger than the diameter of the pin. It is therefore possible for play to exist between the cavity and pin, both in the direction of axis XX' of the ski and at right angles thereto. The cooperation between the pin and cavity makes it easier for the skier to center his boot on block 230 when he presents it at an angle to the ski. Again, this is an arrangement which makes it still easier to fit the ski. Moreover, the play between pin 210 and cavity 220 naturally allows the bottom surface of the boot to be presented at an angle in relation to the top surface of the ski. The cavity could, of course, be of a different shape, for instance circular. It should be noted that the existence of pin 210 makes it possible to impose a definite trajectory upon the boot in the event of a safety release.

Figure 28:
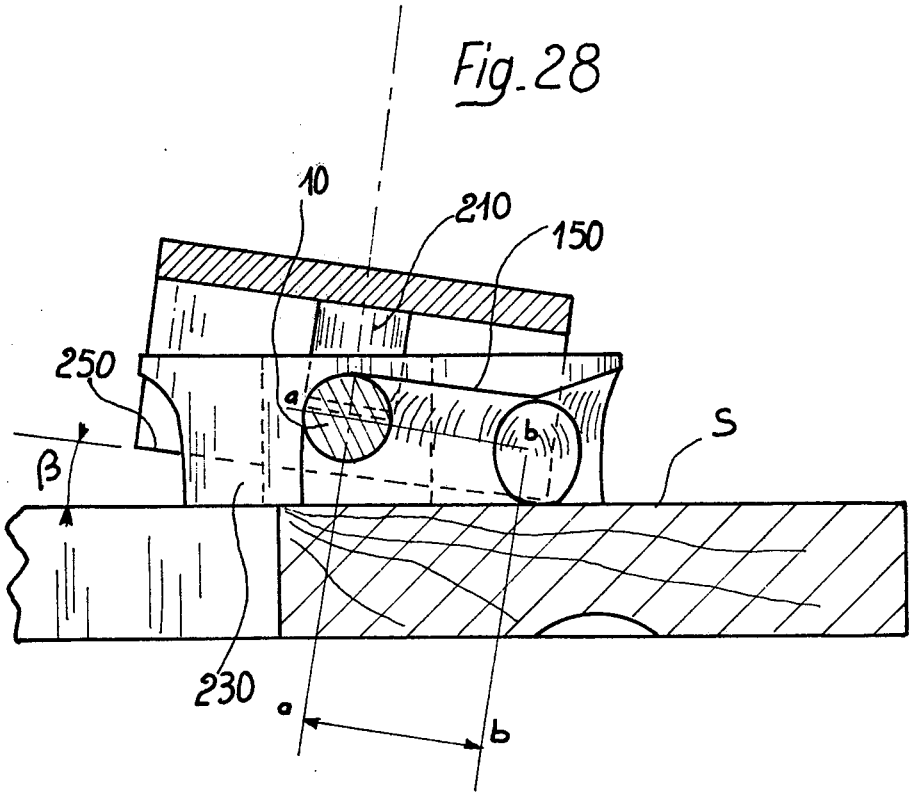
FIG. 28 is a section along the line 28—28 in FIG. 27, to an enlarged scale.

FIG. 28 illustrates particularly clearly the significance to the boot of guide ramp 150. It may be gathered from this figure that, at the beginning of the ski-fitting operation, piston 10 is high up on ramp 150 which allows lower plane 250 of the plate to be concurrent with plane S of the ski and to form therewith a certain angle $\beta$. During the fitting of the ski, piston 10 will follow the path a-b and locking will then take place, with the piston or pistons entering the corresponding housing or housings.

In the three preceding embodiments, it is the bottom surface of the plate that is in contact with the top surface of the ski. A space e (see FIGS. 18,24,26) is therefore provided between the top surface of block 50, 160 or 230 and the bottom surface of depression 5*a*, in order to prevent these surfaces from bearing one upon the other. However, it would be possible to provide a different arrangement, as already indicated hereinbefore, according to which the bottom surface of depression 5*a* in the plate would bear upon the top surface of the block, in which case it would, of course, be necessary to prevent the bottom surfaces of the front and rear parts of the plate from bearing upon the ski; in fact there would have to be a space between them. It should be noted that the guide ramps in the proposed designs make it possible to fit the ski from the right or from the left, in relation to the longitudinal axis of the ski. This is not a mandatory arrangement, in that it would be possible to arrange for the ski to be fitted only from the right or only from the left, or even from the right for one ski and from the left for the other ski. In this case there would be a corresponding reduction in the number of guide ramps.

Figure 29:
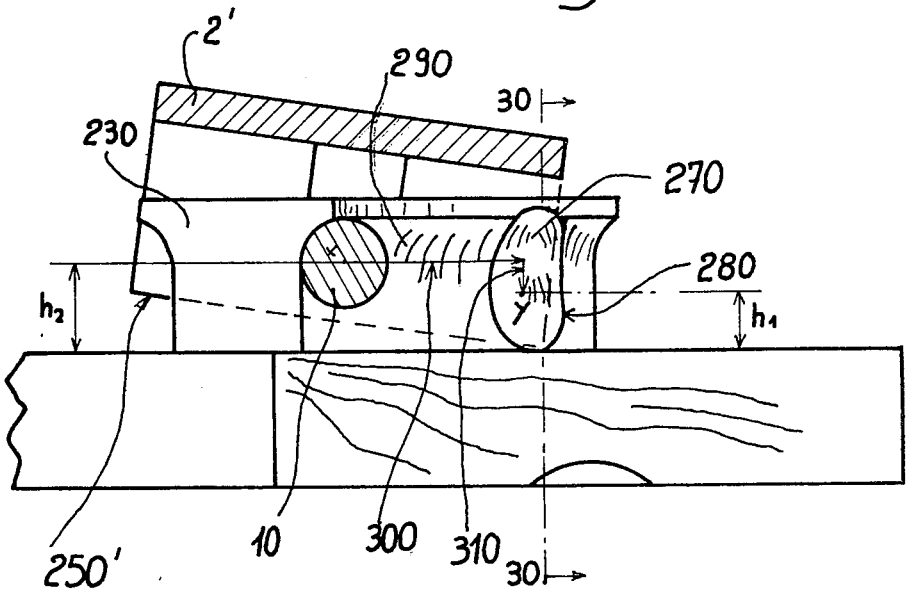
FIGS. 29 and 30 are a view similar to that in FIG. 28 (but showing a ramp of a different configuration) and a section along line 30-30 in FIG. 29, respectively.
Figure 30:
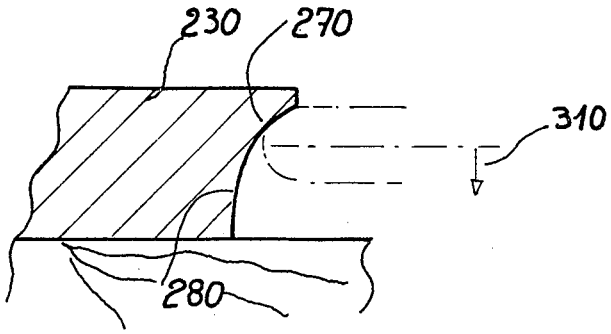

In the variant illustrated in FIGS. 29 and 30, as in FIG. 28, locking pistons 9,10 are mounted in plate 2 attached underneath the boot, whereas the system of guide ramps is arranged in block 230 which also contains housings 280 for locking pistons 10.

Like FIG. 28, FIG. 29 shows the beginning of the ski-fitting operation, at which time bottom surface 250' of plate 2' is at a slight angle in relation to the top surface of the ski.

The ramp system consists of a first concave part 290 parallel with the plane of the ski, and of a second part 270 as a part of a sphere joined to housing 280 on one side and to ramp part 80 on the other side. Thus when the skier rotates his foot, piston 10 will initially be guided, by horizontal part 290 of the ramp, along the path indicated by arrow 300. Then, when the piston reaches part 270 of the ramp, it can descend vertically in the direction of arrow 310.

It will be understood, of course, that if plate 2' straightens up and bears, with its bottom surface, upon the ski before piston 10 reaches part 270 of the ramp, ramp 290 will not oppose this vertical movement. This means that as long as piston 10 is in contact with ramp 290, there is a possibility of vertical play between plate 2' and the ski. In the example indicated, this play is equal to $h_2$-$h_1$, $h_2$ representing the uppermost position of the piston and $h_1$ the lowermost. This play also represents the departure from parallelism that can be taken up by the ramp system.

Figure 31:
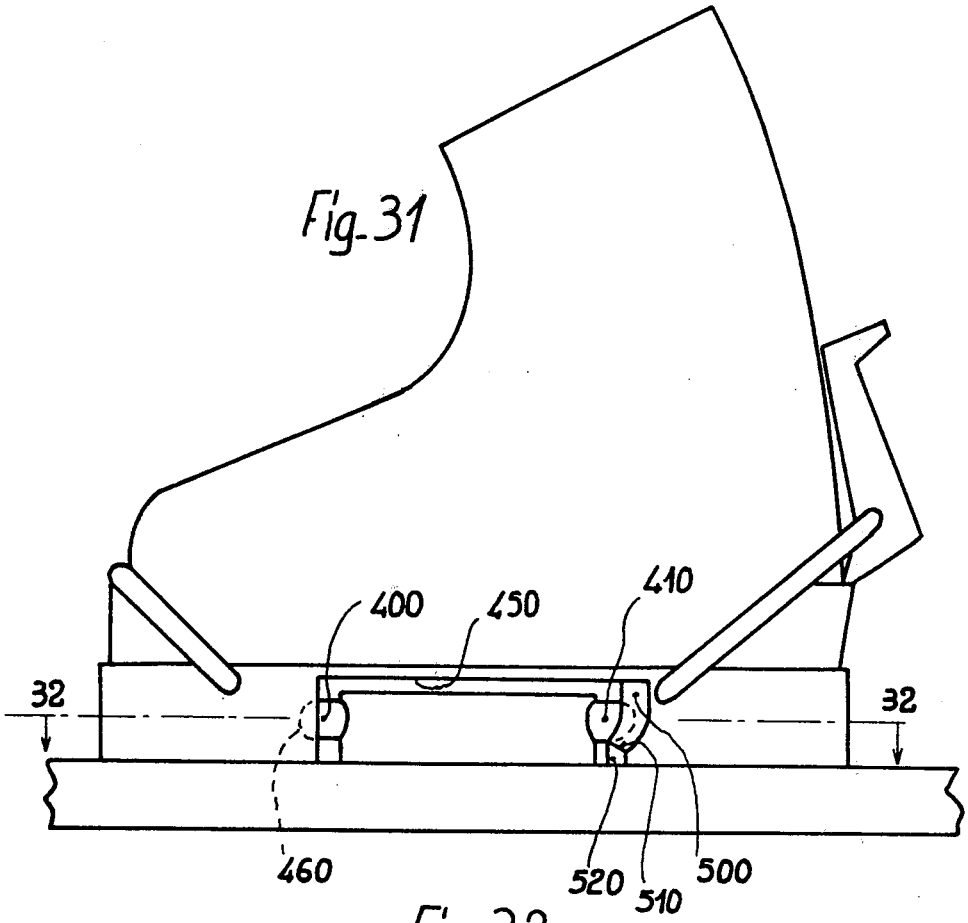
FIGS. 31 and 32 are a side elevation and a section (along line 32-32 in FIG. 31) respectively, illustrating a variant in which the guide ramps are located in the plate.
Figure 32:
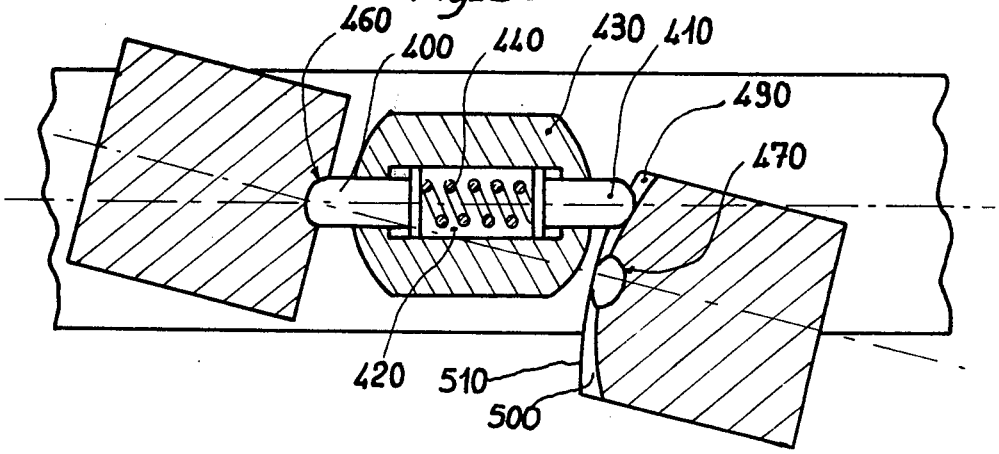

Finally, and as illustrated in FIGS. 31 and 32, it would be possible, as a variant of the preceding embodiments, to mount pistons 400,410 in a longitudinal channel 420 in a block 430 secured to the ski, with a common spring 440 causing the pistons to project outwardly. This arrangement is similar to that shown in FIGS. 12 and 13. In this case, housings 460,470, designed to cooperate with the pistons, are arranged in the front and rear faces of cut-out 450 in plate 480 temporarily secured underneath the boot. In a similar manner, the guide ramps are arranged in the plate.

According to FIGS. 31 and 32, a single pair of ramps 490,500 is provided on each side of rear housing 470. The rear wall of cut-out 450 is convex at 520 to allow for the movement of piston 410. Helical edge 510, produced by the intersection of ramp 490-500 with wall 520, naturally slopes in a direction opposite to that shown in FIGS. 18 to 28. The slope of edge 510 rises from the outside to the inside of the plate towards housing 470 which is located, in the position shown in FIG. 31 with the ski fitted, at a higher level in relation to the plane of the ski than the outer end of the edge.

One of the two pistons of the means of retention could, of course, be in the form of a stationary, non-retractable projection, the other piston being still spring-loaded. It would also be possible to provide a number n of pistons (n being more than 2), and any other type of locking elements, such as pivoting jaws, pivoting fingers, etc.

Similarly, it would, of course, be possible to provide a structure identical with the design illustrated in FIGS. 26 and 27, with a pivot and a double set of ramps (in which case the ramps would be on the boot).

What is claimed is:

1. Safety binding for releasably attaching a ski boot to a ski and allowing said ski to be fitted after release by rotating said boot on said ski, in a plane substantially parallel therewith, from a position transverse relative to said ski to a position wherein said boot is aligned with the longitudinal axis of and locked to said ski, said binding having (a) first connecting means secured to said ski and second connecting means secured to said boot, said connecting means being located under the skier's foot and one of them being substantially covered the other;

(b) releasable retention means maintaining said boot upon said ski in the locked position and comprising at least a first locking element associated with the connecting means secured to said ski, and at least a second locking element associated with the connecting means secured to said boot, one of said locking elements having the form of a concave profile or housing and the other the form of a projection cooperating with said housing, said projection being resiliently retractable against the action of a resilient element in order to allow release of said boot; and (c) a system of guide ramps located in the immediate vicinity of said concave profile or housing, said guide ramps having a curved part extending laterally from said housing in a plane substantially parallel with the plane of contact between said boot and said ski and a projecting part vertically spaced from said housing, said projecting part protruding relative to said housing and to said curved part and cooperating with said resiliently retractable projection in such a manner that a vertical thrust applies said boot towards said ski to prevent its vertical separation during rotation of said boot prior to locking.

2. A binding according to claim 1, wherein said projecting part extends substantially tangentially to said housing.

3. A binding according to claim 1, wherein said system of ramps presents a curved configuration in a plane perpendicular to the plane of contact between said boot and said ski.

4. A binding according to claim 1, wherein said housing, or housings, are arranged in a block secured to the top surface of the ski, said projection being arranged in a part integral with said ramp system being arranged in said block, said projecting ramp being located above the housing with which it is associated.

5. A binding according to claim 4, wherein said block has two housings and two guide ramps, one of said guide ramps being arranged in the vicinity of one of said housings and the other in the vicinity of the other of said housings.

6. A binding according to claim 4, wherein said block has two guide ramps, both arranged on each side of the housing adjacent the heel of said boot, said ramps converging towards said housing.

7. A binding according to claim 4, wherein said block has two pairs of guide ramps, each pair being located in the vicinity of one of said housings, and the ramps of each pair being located on each side of the corresponding housing.

8. A binding according to claim 4, wherein two housings are arranged in the stationary block while two projections are associated with said boot, the projecting parts of the two ramps being located at different distances from the upper plane of said ski.

9. A binding according to claim 8, wherein the projecting part of said ramp closest to the front of said boot is located nearer to the upper plane of said ski than the projecting part of said ramp adjacent the rear of said boot.

10. A binding according to claim 1, wherein said housing, or housings, are arranged in the sole of said boot, whereas the projection, or projections, are arranged in a block secured to said ski, said ramp system being arranged in the sole of said boot, while the projecting ramp part is located below the housing with which it is associated.

11. A binding according to claim 1, wherein said projecting part or shoulder of said ramp system is parallel with the plane of contact between said boot and said ski.

12. A binding according to claim 1, wherein the projecting part of said ramp system is at an angle to the plane of contact between said ski and said boot, sloping towards said housing, thereby defining a profile cooperating with said projecting part in order to guide it towards the corresponding housing.

13. A binding according to claim 12, wherein the configuration of said guide ramp is substantially helical.

14. A binding according to claim 1, wherein at least a part of the surface of said boot resting upon said ski, and located under the toe of the foot, is chamfered laterally, starting from the longitudinal axis of said ski, said chamfered part forming an angle with said ski.

15. A binding according to claim 14, wherein the part located under the toe of said boot is chamfered laterally on each side of an edge running along the longitudinal axis of the boot-ski assembly.

16. A binding according to claim 1, including a pin extending perpendicularly to the support surface of said boot and towards said surface, said pin being arranged in a depression in said boot and cooperating with a cavity arranged in said connecting means secured to said ski.

17. A binding according to claim 16, wherein said cavity in the connecting means is in the form of a slot extending along the longitudinal axis of said ski, the width of said slot being slightly greater than the diameter of said pin.

18. A binding according to claim 17, wherein said pin is located upon the longitudinal axis of said boot.

* * * * *